US011311432B2

(12) United States Patent
Gallingani

(10) Patent No.: US 11,311,432 B2
(45) Date of Patent: Apr. 26, 2022

(54) WHEELCHAIR LIFT FOR MOUNTING TO A VEHICLE

(71) Applicant: Autolift S.r.l., Pegognaga-Mantova (IT)

(72) Inventor: Marco Gallingani, Reggio Emilia (IT)

(73) Assignee: Autolift S.r.l., Pegognaga (IT)

( * ) Notice: Subject to any disclaimer, the term of this patent is extended or adjusted under 35 U.S.C. 154(b) by 0 days.

(21) Appl. No.: 17/061,780

(22) Filed: Oct. 2, 2020

(65) Prior Publication Data

US 2021/0106474 A1 Apr. 15, 2021

(30) Foreign Application Priority Data

Oct. 11, 2019 (EP) ..... 19202713

(51) Int. Cl.
*A61G 3/06* (2006.01)

(52) U.S. Cl.
CPC ..... *A61G 3/062* (2013.01)

(58) Field of Classification Search
CPC ..... A61G 3/062; A61G 3/067; A61G 3/085; A61G 2220/16; A61G 2220/14; A61G 2220/12; Y10S 414/134; B60P 1/4414; B60P 1/4442
USPC ..... 414/537, 556
See application file for complete search history.

(56) References Cited

U.S. PATENT DOCUMENTS 6,086,314 A * 7/2000 Savaria ..... A61G 3/06 414/546
6,089,817 A 7/2000 Tauer
6,102,648 A 8/2000 Fretwell et al.
2002/0149007 A1* 10/2002 Beck ..... B60P 1/4442 254/8 B
2004/0146386 A1* 7/2004 Goodrich ..... A61G 3/062 414/546
2004/0228713 A1* 11/2004 Cohn ..... B60P 1/4457 414/546
2006/0104775 A1* 5/2006 Kasten ..... B60P 1/4457 414/546
2007/0224025 A1* 9/2007 Ablabutyan ..... A61G 3/062 414/546

FOREIGN PATENT DOCUMENTS

WO 2015/133978 A2 9/2015

* cited by examiner

*Primary Examiner* — Glenn F Myers
(74) *Attorney, Agent, or Firm* — Collard & Roe, P.C.

(57) ABSTRACT

A wheelchair lift for mounting to a vehicle includes a platform assembly configured to support a wheelchair. The wheelchair lift includes a roll stop to be moved between an entry position to allow a wheelchair to be loaded to or unloaded from the platform assembly, and a barrier position to prevent the wheelchair from falling off the platform assembly. The wheelchair lift includes a mechanical actuator mechanism for moving the roll stop between the entry position and the barrier position. The mechanical actuator mechanism is configured to keep the roll stop in the entry position, when the platform assembly is in a ground level position, and to block the roll stop from moving from the barrier position to the entry level position, when the platform assembly is in the horizontal position.

14 Claims, 15 Drawing Sheets

WHEELCHAIR LIFT FOR MOUNTING TO A VEHICLE

CROSS REFERENCE TO RELATED APPLICATIONS

Applicant claims priority under 35 U.S.C. § 119 of European Application No. 19202713.4 filed Oct. 11, 2019, the disclosure of which is incorporated by reference.

BACKGROUND OF THE INVENTION

1. Field of the Invention

The disclosure is directed to a wheelchair lift for mounting to a vehicle, such as a car or a public transportation vehicle, for example a bus.

2. Description of the Related Art

A vehicular wheelchair lift is utilized to facilitate lifting of a wheelchair into a vehicle. The wheelchair lift usually comprises a platform assembly to load a wheelchair, a lifting device to lift the platform assembly and a power unit to provide power for driving the lifting device. The platform assembly may be lifted by the lifting device from a ground level position outside the vehicle to an entry level position having the level of the floor of the vehicle. A person sitting in a wheelchair can enter a platform of the platform assembly, when the platform assembly is in the ground position, and enter the vehicle from the wheelchair lift, when the platform assembly is in the entry level position, or vice versa.

The wheelchair lift may be disposed inside the vehicle. However, wheelchair lifts which are mounted inside the car are usually bulky devices which waste a lot of area inside the vehicle. Another generation of wheelchair lifts, the so called underfloor lifts, are mounted to a bottom side of the vehicle. An underfloor wheelchair lift usually comprises a cassette in which the platform assembly and the mechanical components, such as the lifting device, and the power unit are housed.

The underfloor wheelchair lift has to be constructed with a low construction height so that the cassette of the wheelchair lift may be mounted to the bottom side of the vehicle with sufficient distance from the ground. Furthermore, the construction of the underfloor wheelchair lift should ensure that the wheelchair lift can be mounted to the bottom side of the vehicle without modifying components of the vehicle, such as a tank or an exhaust system, or modifying the arrangement of such components.

Another construction of wheelchair lifts in the vehicles is available especially for public transport. In this design, the wheelchair lifts are installed inside a casing of a vehicle, e.g. a bus. The wheelchair lift may be installed, for example, in a step of entrance/exit stairs of a vehicle. A wheelchair lift may comprise a cassette in which the platform assembly is housed. The cassette may be mounted in the casing of the vehicle, for example in a step of entrance/exit stairs for entering or exiting the vehicle. The platform assembly of the wheelchair lift can be pulled out of the casing, if necessary. When pulled out, the platform assembly can be lowered from a horizontal position to the ground level position to load a wheelchair and lift up to the entry level position to unload the wheelchair for entering the vehicle.

The wheelchair lift usually comprises a roll stop means being movably disposed at a front side of the platform assembly. In the ground level position, the roll stop means has to be opened/folded down so that a wheelchair can enter or leave the platform of the platform assembly. On the other hand, when moving the platform assembly between the ground level position and the entry level position, the roll stop means has to be closed/folded up so that the wheelchair loaded on the platform is prevented by the roll stop means from rolling off the platform.

Regarding a wheelchair lift mounted in a casing of a vehicle, for example in a step of entrance/exit stairs of the vehicle, the roll stop means is additionally used as a facing/cover for covering the casing or covering the cavity of the cassette in which the platform assembly is housed in the stowed/horizontal position of the platform assembly. When the opening of the cavity of the casing or the cassette has to be closed by the roll stop means in the stowed/horizontal position of the platform assembly, it has to be ensured that the roll stop means is folded up in the stowed/horizontal position of the platform assembly, when the platform assembly is inserted in the cavity of the casing of the vehicle or the cassette of the wheelchair lift.

The movement of the roll stop means between the open/folded-down state and the closed/folded-up state may be controlled by an electric motor coupled to an electric sensor or by a hydraulic system. The sensor may be configured to detect the position of the platform assembly, and the motor or hydraulic system controls the state of the roll stop means. In particular, the motor or the hydraulic system moves the roll stop means in the open/folded down state, when the platform assembly arrives at the ground or entry level position, and moves the roll stop means in the closed/folded-up state, when the platform assembly reaches the stowed/horizontal position for being inserted in the cavity of the casing of the vehicle or the cassette of the wheelchair lift. However, an electric system comprising the electric motor and the electric sensor or a hydraulic system is complex and can easily be damaged and break down.

There is need to provide a wheelchair lift for mounting in a vehicle comprising a roll stop means to allow a wheelchair to enter a platform of a platform assembly and to prevent a wheelchair from rolling off the platform, wherein the movement of the roll stop means is controlled in a reliable manner.

SUMMARY OF THE INVENTION

An embodiment of a wheelchair lift for mounting in a vehicle comprising a robust and reliable mechanism to move a roll stop means between a closed/folded-up state and an open/folded-down state is specified in accordance with the invention.

The wheelchair lift for mounting in a vehicle comprises a platform assembly being configured to support a wheelchair and to be moved between an entry level position, a horizontal position and a ground level position. The entry level position is above the horizontal position and the ground level position is below the horizontal position. The horizontal position is between the entry level position and the ground level position.

The wheelchair lift further comprises a roll stop means to be moved between an entry position to allow a wheelchair to be loaded to or unloaded from the platform assembly, and a barrier position to prevent the wheelchair from falling off the platform assembly.

The wheelchair lift further comprises a mechanical actuator mechanism to move the roll stop means between the entry position and the barrier position. The mechanical actuator mechanism is configured to keep the roll stop means in the entry position, when the platform assembly is in the ground level position. Furthermore, the mechanical actuator mechanism is configured to block the roll stop means from moving from the barrier position to the entry level position, when the platform assembly is in the horizontal position.

According to a possible embodiment, the wheelchair lift is configured as a built-in wheelchair lift for mounting to a vehicle, in particular, for mounting under a vehicle (under-floor-lift) or for mounting in a casing of a vehicle, for example, in a step of exit/entrance stairs of the vehicle. The mechanical actuator is configured to block the roll stop means from moving to the entry level position, and thus to keep the roll stop means in the barrier position, when the platform assembly is inserted in the casing of the vehicle. The roll stop means is configured such that the cavity of the casing of the vehicle is covered by the roll stop means, when the platform assembly is inserted in the casing.

According to a possible embodiment, the wheelchair lift may comprise a cassette to house the platform assembly. The cassette is configured for mounting in the casing of the vehicle. The cassette has a cavity to insert the platform assembly. In the horizontal position of the platform assembly, the platform assembly is configured to be moved in the cavity of the cassette by a translational movement of the platform assembly. The mechanical actuator mechanism is configured to keep the roll stop means in the barrier position, when the platform assembly is inserted in the cavity of the cassette. In this case, the opening of the cavity of the cassette is covered/closed by the folded-up roll stop means.

According to the proposed configuration, the wheelchair lift uses a mechanical actuator mechanism instead of an electric system or a hydraulic system including hydraulic cylinders to move the roll stop means between the entry position and the barrier position. Hydraulic or electric drives have a big disadvantage with regard to emergency operation: In this case a user needs to do an extra operation to release a valve or to remove a pin in order to open the roll stop means, i.e. to move the roll stop means from the barrier position to the entry position.

The proposed mechanical actuator system allows the roll stop means to open automatically when the platform assembly touches the ground. The mechanical actuator mechanism provides a robust system for moving the roll stop means between the entry position and the barrier position in a reliable way. The mechanical actuator mechanism allows the roll stop means to be moved in the entry position, i.e. to open/fold-down the roll stop means for loading/unloading a wheelchair lift to/from a platform of the platform assembly, when the platform assembly is moved in the ground level position. According to a possible embodiment, the mechanical actuator mechanism comprises a spring mechanism to move the roll stop means from the closed/barrier position to the open/entry position, when the platform assembly is placed on the ground.

According to a possible embodiment of the wheelchair lift, the mechanical actuator mechanism comprises a lever for moving the roll stop means between the barrier position and the entry position. The lever is arranged to block the roll stop means from moving from the barrier position to the entry position although the spring mechanism urges moving the roll stop means in the entry position. The lever is rotatably mounted to the platform assembly. When the lever bears on a bearing surface, the lever is moved upwards and releases the roll stop means for moving from the barrier position to the entry position. After being released, the roll stop means is urged by the spring mechanism to be moved from the barrier position to the entry position.

The mechanical actuator mechanism is configured to exert a force on the roll stop means so that the roll stop means is kept in the barrier position when the platform assembly is in the horizontal position, even if the lever bears on any bearing surface. When the wheelchair lift is configured as a built-in wheelchair lift mounted in a casing of a vehicle, for example in a step of entrance/exit stairs of a vehicle, the mechanical actuator mechanism prevents the roll stop means from being moved from the barrier position to the entry position, even if the lever bears on a surface of a step of the entrance/exit stairs during inserting the platform assembly 10 in the casing of the vehicle or in the cassette of the wheelchair lift.

Moreover, when the platform assembly is inserted in the cavity of the casing of the vehicle or in the cavity of the cassette of the wheelchair lift and the lever is lift up and rests on an inner surface of the casing of the vehicle or an inner surface of the cassette of the wheelchair lift, the mechanical actuator mechanism prevents the roll stop means from being moved from the barrier position to the entry position. The roll stop means can thus be used as a cover to close the cavity of the casing of the vehicle or the cavity of the cassette, when the platform assembly is inserted in the cavity of the casing of the vehicle or in the cassette of the wheelchair lift.

The wheelchair lift uses by the mechanical actuator mechanism a pure mechanical system to control the movement of the roll stop means. In particular, the mechanical actuator mechanism is configured such that the roll stop means is moved in a different way in dependence on the position of the platform assembly. When the platform assembly is in the ground level position, the lever of the mechanical actuator mechanism releases the roll stop means such that the roll stop means is moved from the barrier/closed position into the entry/open position, when the lever bears on the ground.

On the other hand, when the platform assembly is in the horizontal position, the mechanical actuator mechanism ensures that the roll stop means is blocked from being released and is kept in the closed/barrier position, even if the lever of the mechanical actuator mechanism bears on any bearing surface, for example a step of entrance/exit stairs of a vehicle, or if the lever is lifted up during the movement of the platform assembly into the casing of the vehicle or the cavity of the cassette and bears on the bottom surface of the casing of the vehicle or the bottom surface of the cassette of the wheelchair lift.

Additional features and advantages are set forth in the detailed description that follows. It is to be understood that both the foregoing general description and the following detailed description are merely exemplary, and are intended to provide an overview or framework for understanding the nature and character of the claims.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

A wheelchair lift 1 for mounting in a vehicle comprises a platform assembly 10 being configured to support a wheelchair to be moved between an entry level position, a horizontal position and a ground level position. The wheelchair lift may be configured as a built-in wheelchair lift for directly mounting the platform assembly under a vehicle or in a casing of a vehicle. According to another embodiment of the wheelchair lift shown in the appended figures, the wheelchair lift may comprise a cassette for housing the platform assembly. The cassette of the wheelchair lift may be mounted in the casing of the vehicle.

Figure 1:
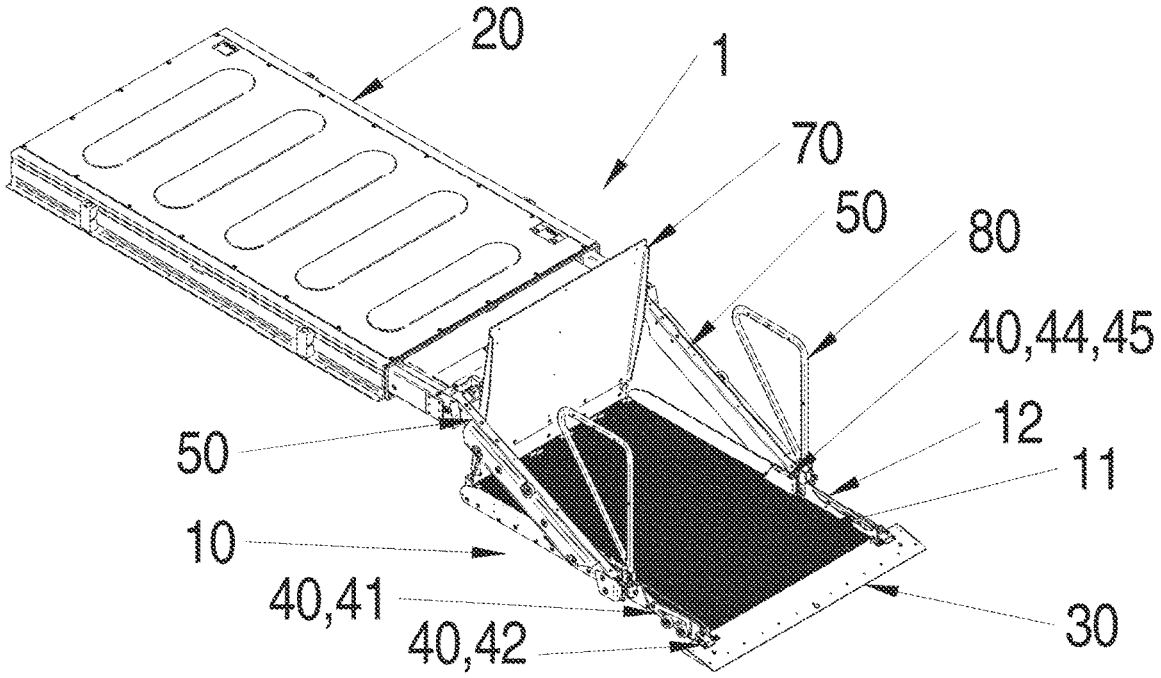
FIG. 1 shows a perspective view of a wheelchair lift for mounting in a vehicle with a platform assembly in an entry level position.
Figure 2:
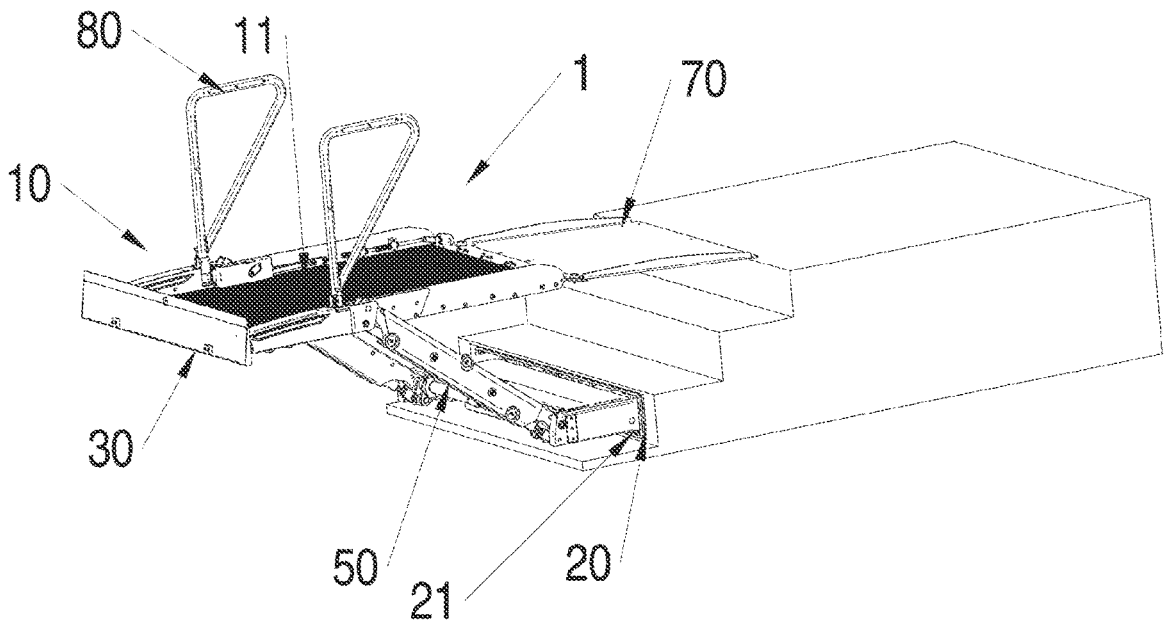
FIG. 2 shows a perspective view of a wheelchair lift being configured as built-in lift to be mounted in a step of stairs of a vehicle, the lift being in an entry level position.
Figure 3:
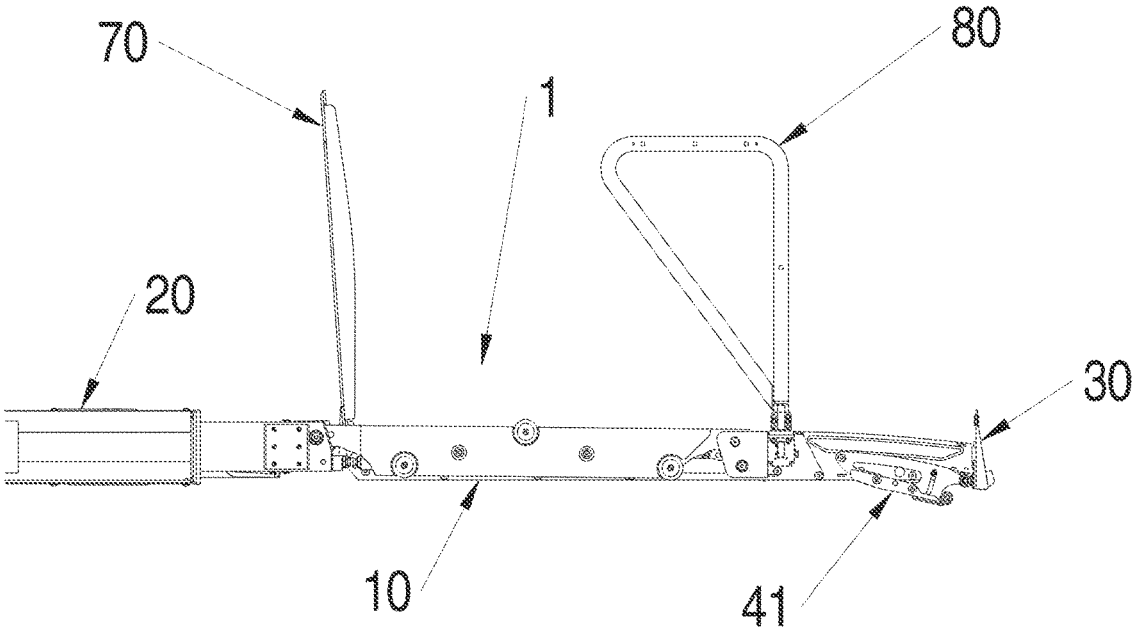
FIG. 3 illustrates a perspective view of a wheelchair lift for mounting in a vehicle with a platform assembly being in a horizontal position.

FIG. 1 shows the wheelchair lift 1 with a platform assembly 10 in the entry level position. FIG. 2 shows the wheelchair lift 1 with the platform assembly 10 in the entry level position, and FIG. 3 illustrates the wheelchair lift 1 with the platform assembly 10 in the horizontal position. As illustrated in FIGS. 1 to 3, the entry level position (FIG. 2) is above the horizontal position (FIG. 3) and above the ground level position (FIG. 1). The horizontal position is between the entry level position and the ground level position. The horizontal position of the platform assembly 10 is on the same level as the cassette 20.

The wheelchair lift 1 comprises a cassette 20 to house the platform assembly 10. The cassette 20 has a cavity 21 to insert the platform assembly 10. In the horizontal position of the platform assembly 10, the platform assembly 10 is configured to be moved in the cavity 21 of the cassette 20 by a translational movement of the platform assembly 10. The wheelchair lift further comprises a roll stop means 30 to be moved between an entry position to allow a wheelchair to be loaded to or unloaded from the platform assembly 10.

FIG. 1 shows the roll stop means 30 in the entry position with a platform assembly 10 lowered to the ground level position. The roll stop means 30 is folded down in the entry position. The roll stop means 30 is further configured to be moved in a barrier position to prevent the wheelchair lift from being loaded to or unloaded from the platform assembly 10. In particular, in the barrier position, the roll stop means 30 prevents the wheelchair from rolling/falling off the platform assembly 10. FIG. 2 and FIG. 3 show the roll stop means 30 in the barrier position in which the roll stop means 30 is folded up. The roll stop means 30 is rotatably coupled to the platform assembly 10 for moving between the entry position and the barrier position.

The wheelchair lift 1 comprises a mechanical actuator mechanism 40 for moving the roll stop means 30 between the entry position/open position and the barrier position/closed position. The mechanical actuator mechanism 40 is configured to keep the roll stop means 30 in the entry position, when the platform assembly 10 is in the ground level position. The mechanical actuator mechanism 40 is further configured to block the roll stop means from moving to the entry level position, and thus to keep the roll stop means 30 in the barrier position, when the platform assembly 10 is in the horizontal position.

The wheelchair lift 1 comprises a lifting arm 50 to move the platform assembly 10 between the entry level position, the horizontal position and the ground level position. The mechanical actuator mechanism 40 is mechanically coupled to the movement of the lifting arm 50. As illustrated in FIG. 1, the lifting arm 50 is in a lowered position in relation to the cassette 20, when the platform assembly 10 is in the ground level position. The lifting arm 50 is in a raised position in relation to the cassette 20, when the platform assembly 10 is in the entry level position, as shown in FIG. 2. Referring to FIG. 3, the lifting arm 50 is in a horizontal position being on the same level as the cassette 20, when the platform assembly 10 is in the horizontal position.

The mechanical actuator mechanism comprises a spring mechanism 42 to urge moving the roll stop means 30 from the barrier position to the entry position. The wheelchair lift further comprises a bridging plate 70 being movably arranged at the platform assembly 10. As illustrated in FIG. 2, the bridging plate 70 may be folded down in the entry level position of the platform assembly 10 so that a wheelchair loaded on platform 11 of the platform assembly 10 can enter a floor of a vehicle via the bridging plate 70, when the platform assembly 10 is moved in the entry level position.

The wheelchair lift 1 may optionally comprise handrails 80 to allow a person with a disability sitting in a wheelchair to hold onto the handrails 80.

Figure 4:
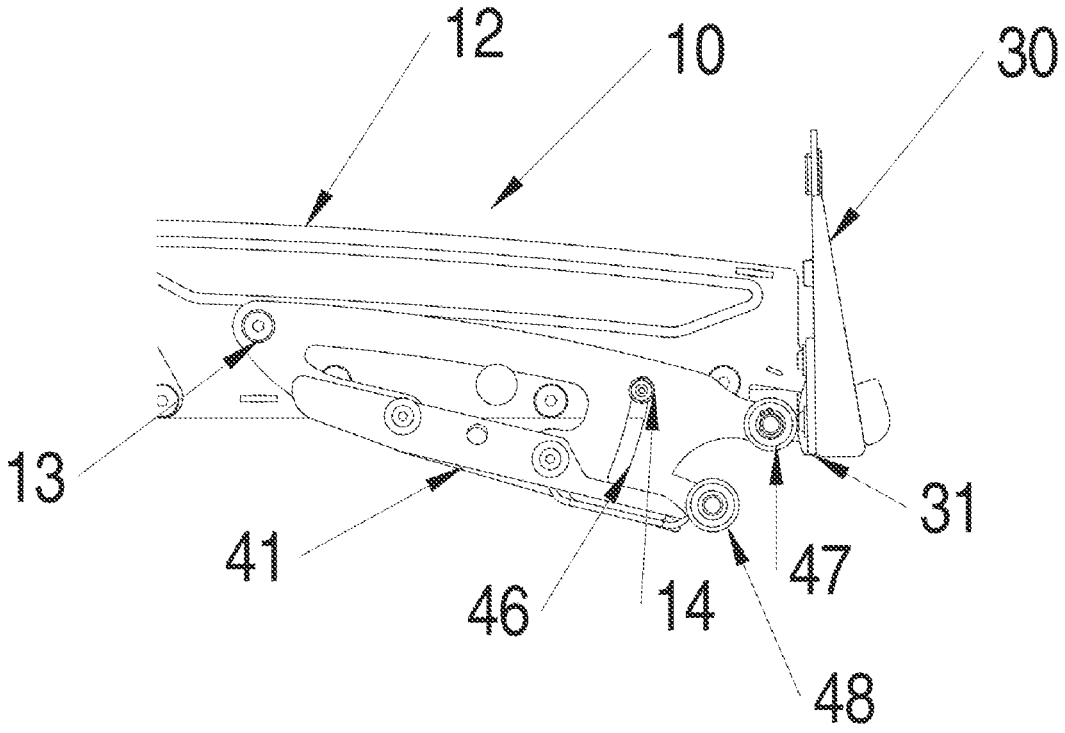
FIG. 4 illustrates a mechanical actuator mechanism comprising a lever for moving a roll stop means, the roll stop means being in a barrier position.
Figure 5:
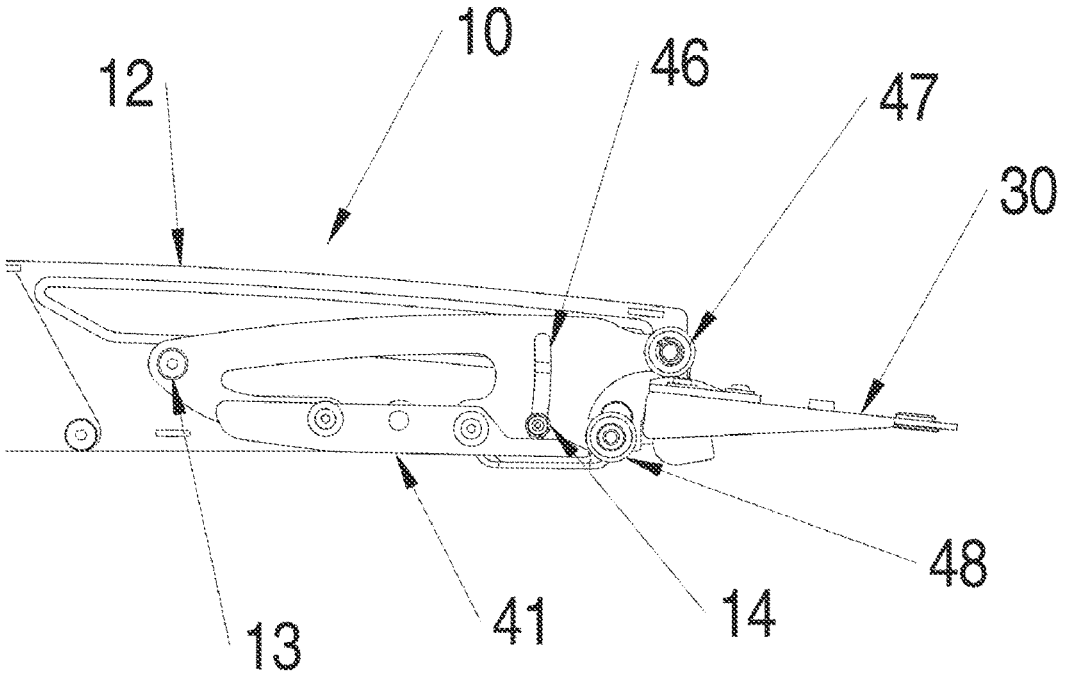
FIG. 5 shows a mechanical actuator mechanism comprising a lever for moving a roll stop means, the roll stop means being in an entry position.

FIG. 4 shows a cut-out of the platform assembly 20 in the horizontal position (FIG. 3) with the roll stop means 30 in the barrier position/fold-up state. FIG. 5 shows the cut-out view of the platform assembly 10 in the ground level position with the roll stop means 30 in the entry position/open state.

Referring to FIGS. 4 and 5, the mechanical actuator mechanism 40 comprises a lever 41 for moving the roll stop means 30 between the barrier position and the entry position. The lever 41 is rotatably mounted to the platform assembly 10 such that the lever 41 is moved during the movement of the platform assembly 10, when the lever 41 bears on a bearing surface. The lever 41 is rotatably mounted to a side panel 12 of the platform assembly 10 by means of a hinge 13. The lever 41 has a guide groove 46 in which a guide pin 14 engages to guide the rotary movement of the lever 41, when the lever 41 touches the ground and the platform assembly 10 is lowered further.

The roll stop means 30 is mechanically coupled to the lever 41 such that the roll stop means 30 is moved from the barrier position shown in FIG. 4 to the entry position shown in FIG. 5, when the platform assembly 10 is lowered to the ground level position and the lever 41 bears on the ground. The lever 41 comprises a bearing wheel 48 which slides on the ground when the platform assembly is lowered to the ground level position. Furthermore, the mechanical coupling between the roll stop means 30 and the lever 41 enables the roll stop means 30 to be moved from the entry position (FIG. 5) to the barrier position (FIG. 4), when the platform assembly 10 is raised from the ground level position and the lever 41 is lifted up from the ground so that it does not rest on the ground any more.

FIG. 4 shows the roll stop means 30 in the barrier position before the lever 41 touches the ground during a lowering movement of the platform assembly. According to a possible embodiment of the wheelchair lift 1, the lever 41 is arranged to block the roll stop means 30 from moving from the barrier position to the entry position by the spring mechanism 42, when the lever 41 is lifted up from the ground. In the barrier position of the roll stop means 30, the lever 41 prevents the roll stop means 30 from being folded down, for example by the force exerted from the spring mechanism 42 to the roll stop means 30. For this purpose, an abutment element 47 of the lever 41 abuts on an abutment element 31 of the roll stop means 30.

Before touching the ground when lowering the platform assembly, lever 41 is pulled downwards by gravity so that the abutment element 47 of the lever 41 is in mechanical contact with the abutment element 31 of the roll stop means 30. In particular, the pin 14 and the groove 46 are arranged relative to each other such that the abutment element 47 of the lever 41 is in mechanical contact with the abutment element 31 of the roll stop means 30, when the lever 41 is pulled downwards by gravity. As shown in FIG. 4, in the downward position of the lever 41, the lever 41 is positioned below the platform assembly 10. The lever 41 is lowered in a downward position until the pin 41 is in contact with an upper end of the guide groove 46.

The lever 41 is arranged to release the roll stop means 30 for moving from the barrier position to the entry position urged by the spring mechanism 42, when the lever 41 bears on the ground. FIG. 5 shows the platform assembly 10 in the ground level position. The lever 41 is put on the ground and is moved upwards so that the abutment element 47 of the lever 41 releases the roll stop means 30. The roll stop means 30 is urged to the entry/open position by a force exerting from the spring mechanism 42 to the roll stop means 30. The rotational movement of the lever 41 is guided by the pin 14 and the groove 46 of the lever 41. In particular, the lever 41 is moved in an upward position until the pin 41 is in contact with the bottom end of the guide groove 41.

Figure 6A:
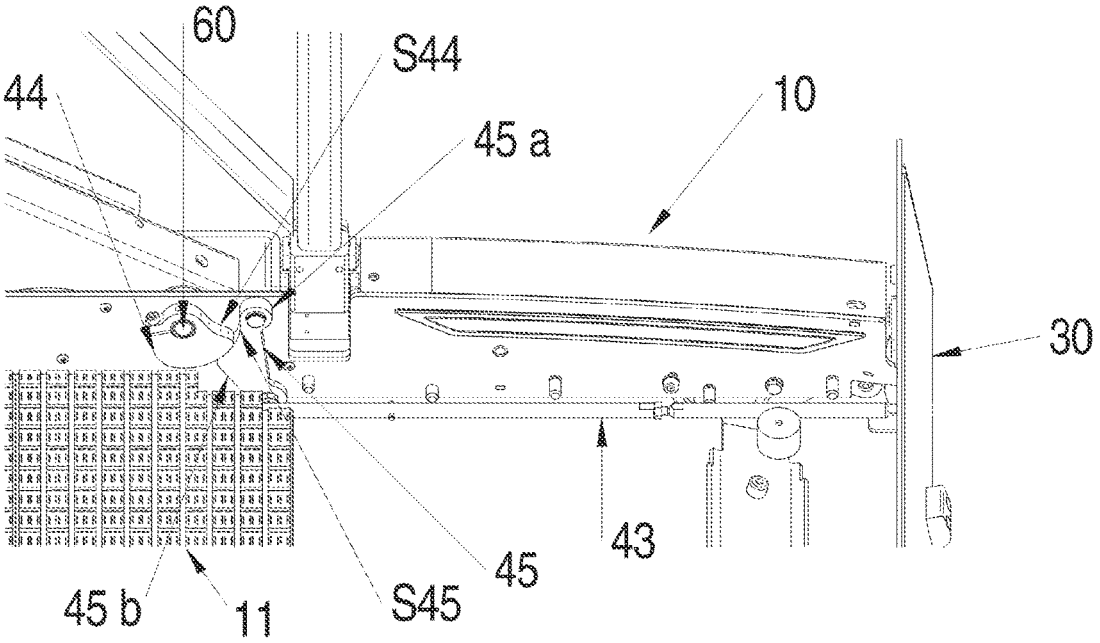
FIG. 6A illustrates a platform assembly in the horizontal position and a mechanical actuator mechanism for moving a roll stop means.
Figure 6B:
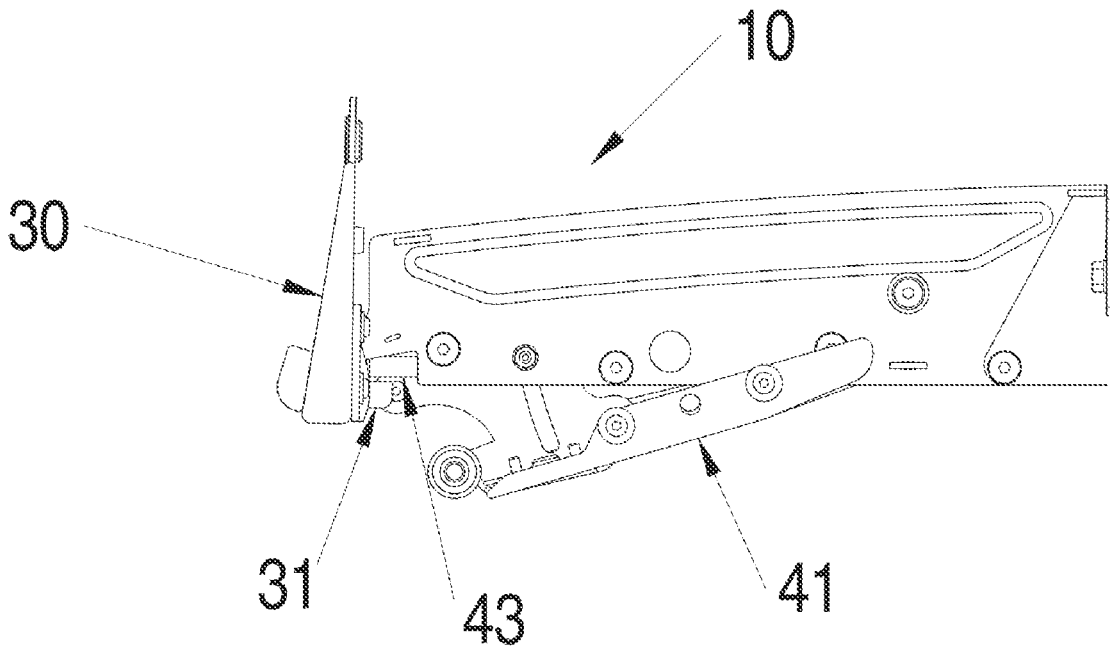
FIG. 6B illustrates a mechanical actuator mechanism for moving a roll stop means, the roll stop means being in a barrier position.
Figure 7A:
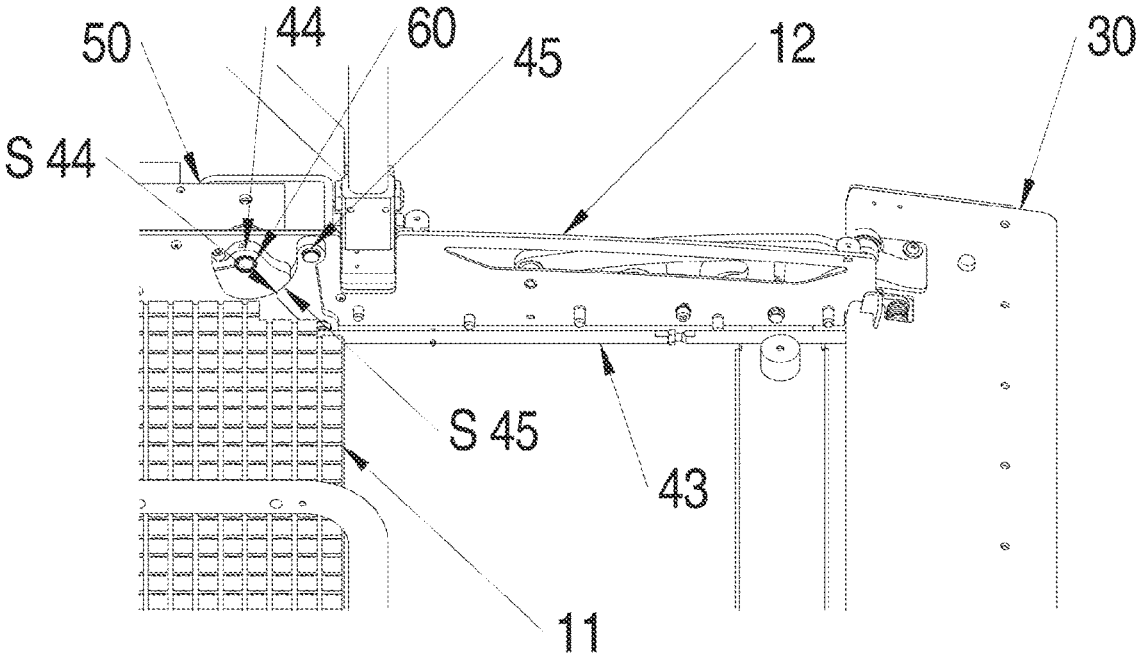
FIG. 7A illustrates a platform assembly in the ground level position and a mechanical actuator mechanism for moving a roll stop means.
Figure 7B:
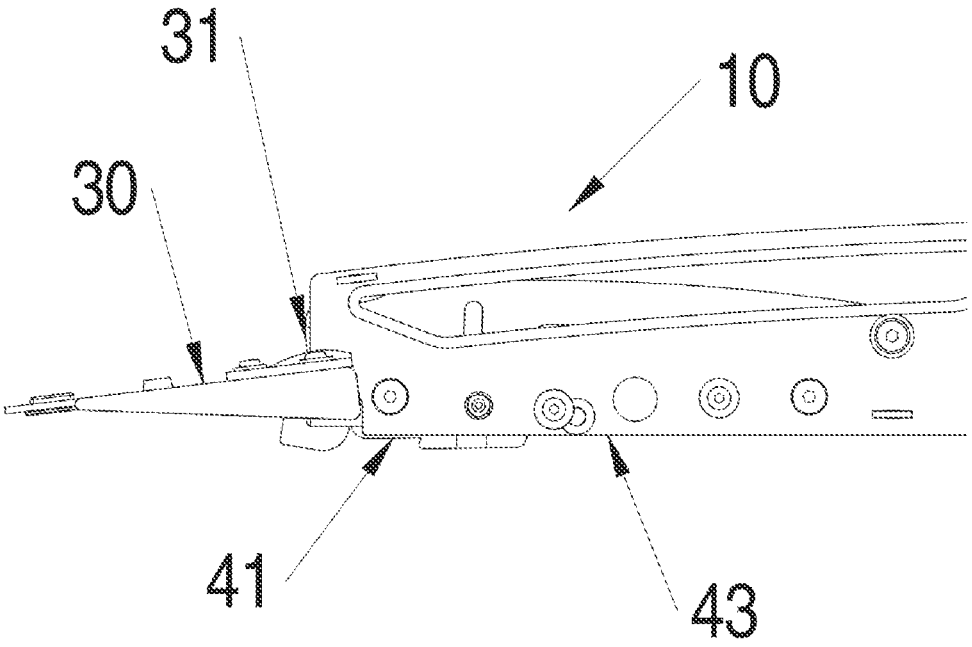
FIG. 7B illustrates a mechanical actuator mechanism for moving a roll stop means, the roll stop means being in an entry position.
Figure 8:
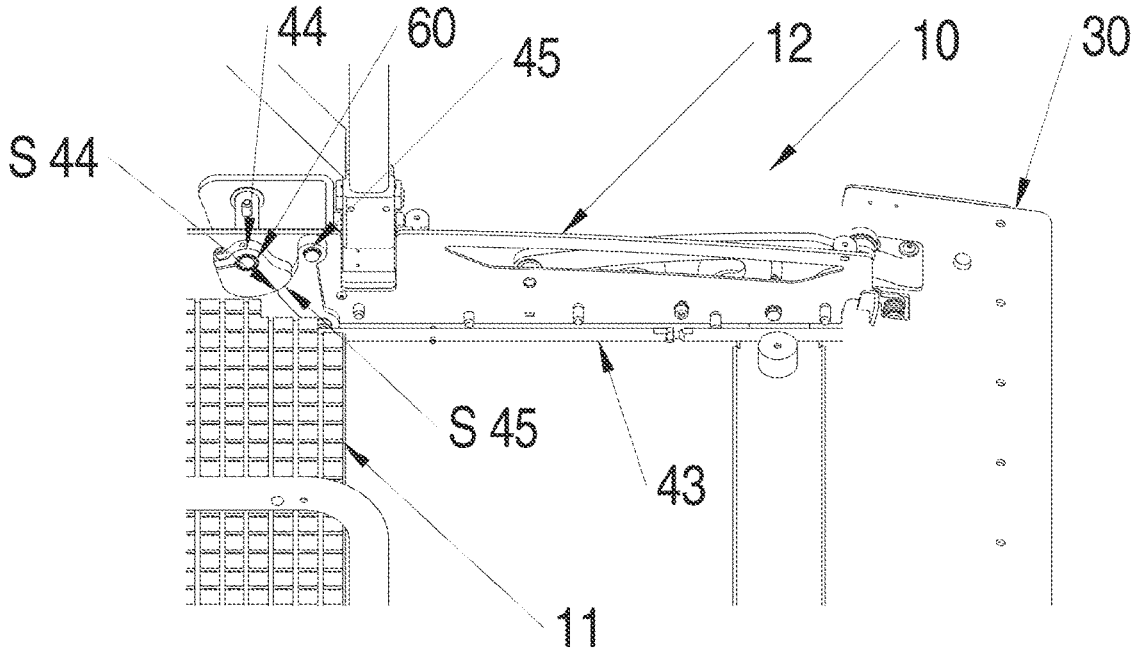
FIG. 8 illustrates a platform assembly in an entry level position and a mechanical actuator mechanism for moving a roll stop means.

FIGS. 6A to 8 show the platform assembly 10 in different positions. FIGS. 6A and 6B show the platform assembly 10 in the horizontal position with the roll stop means 30 in the barrier/closed position. FIGS. 7A and 7B show the platform assembly 10 in the ground level position with the roll stop means 30 in the entry/open position, and FIG. 8 shows the platform assembly 10 in the entry level position with the roll stop means 30 in the barrier/closed position.

The mechanical actuator mechanism 40 comprises a movable bar 43 being mechanically coupled to the movement of the lifting arm 50 such that the bar 43 is moved in a first position, when the platform assembly 10 is moved in the horizontal position, as shown in FIGS. 6A and 6B. In the first position of the bar 43, the bar 43 is extracted and abuts on the roll stop means 30 so that the movement of the roll stop means 30 from the barrier position to the entry position is blocked, even if the lever 41 bears on any bearing surface, for example the ground or the bottom inner surface of the cassette. As shown in FIGS. 6A and 6B a front tip of the bar 43 abuts on the abutment element 31 of the roll stop means 30 or is arranged in near proximity to the abutment element 31 so that any movement of the roll stop means 30 urged by the spring mechanism 42 is prevented by the bar 43.

The mechanical actuator mechanism 40 is further configured such that the movable bar 43 is moved in a second position, different from the first position, when the platform assembly 10 is moved in the ground level position, as illustrated in FIGS. 7A and 7B. In the second position of the bar 43, the bar 43 is retracted from the roll stop means 30 so that the roll stop means 30 is moved from the barrier position to the entry level position, when the platform assembly 10 is lowered to the ground level position and the lever 41 bears on the ground, as illustrated in FIG. 5 and FIG. 7B. Since the bar 43 is retracted in the ground level position of the platform assembly, the bar 43 does not block the rotational movement of the roll stop means 30 urged by the spring mechanism 42. As a result, the roll stop means 30 is moved in the entry/open position, when the lever 41 is lifted up and releases the roll stop means 30.

The mechanical actuator mechanism 40 is further configured such that the movable bar 43 is moved in the first position, when the platform assembly is moved in the entry level position, as illustrated in FIG. 8. The bar abuts on the roll stop means 30 so that the movement of the roll stop means 30 from the barrier position to the entry position is blocked in the entry level position of the platform assembly 10.

A particular embodiment of the mechanical actuator mechanism 40 illustrated in FIGS. 6A to 8 is described in the following. The particular embodiment of the mechanical actuator mechanism 40 is only one possible solution to realize the described function of the mechanical actuator mechanism 40. Any modifications of the mechanical actuator mechanism 40 using the principle to move the roll stop means 30 in response to the position or movement of the lifting arm 50 are possible.

According to the embodiment of the mechanical actuator mechanism 40 shown in FIGS. 6A to 8, the mechanical actuator mechanism 40 comprises cam 44 being mechanically coupled to the lifting arm 50 such that the cam 44 is moved by the movement of the lifting arm 50. As illustrated in FIGS. 6A and 6B, the cam 44 is mechanically coupled to the bar 43 such that the bar 43 is moved to the first position, when the lifting arm 50 is in the horizontal position so that the bar 43 prevents any movement of the roll stop means 30 from the barrier position to the entry position, for example a movement that is urged by the spring mechanism 42.

As further shown in FIG. 7A, the cam 44 is mechanically coupled to the bar 43 such that the bar 43 is moved to the second position, i.e. the retracted position, when the lifting arm 50 is in the lowered position. Referring to FIG. 8, the cam 44 is mechanically coupled to the bar 43 such that the bar 42 is moved to the first position, when the lifting arm 50 is moved in the raised position so that any movement of the roll stop means 30 from the barrier position to the entry position is prevented in the entry level position of the platform assembly 10.

According to a possible embodiment of the wheelchair lift 1, the wheelchair lift comprises a bolt 60 having a first side and a second side. The lifting arm 50 is fixed to the first side of the bolt 60, and the cam 44 is fixed to the second side of the bolt 60 so that the cam 44 is moved by the movement of the lifting arm 50. The bolt 60 for mechanically coupling the movement of the lifting arm to the cam 44 is illustrated in FIGS. 6A, 7A and 8.

According to the embodiment of the mechanical actuator mechanism 40 illustrated in FIGS. 6A to 8, the mechanical actuator mechanism 40 comprises a force transmitter 45 to transmit a force to the movable bar 43 for moving the bar 43 between the first and second position. The force transmitter 45 is mechanically coupled to the cam 44. The force transmitter 45 has a first side 45*a* being rotatably coupled to a side panel 12 of the platform assembly 10 and a second side 45*b* being rotatably coupled to the bar 43.

As illustrated in FIGS. 6A, 7A and 8, a surface S44 of the cam 44 slides along a surface S45 of the force transmitter 45 during the movement of the lifting arm 50 between the horizontal position and the lowered position. The surface S44 of the cam 44 and the surface S45 of the force transmitter 45 are shaped such that the bar 43 is moved to the first position, i.e. the extracted position shown in FIGS. 6A, 6B and 8, when the lifting arm 50 is moved in the horizontal or raised position, and the bar 43 is moved in the second position, i.e. the retracted position, when the lifting arm 50 is moved to the lowered position shown in FIGS. 7A and 7B.

Figure 9A:
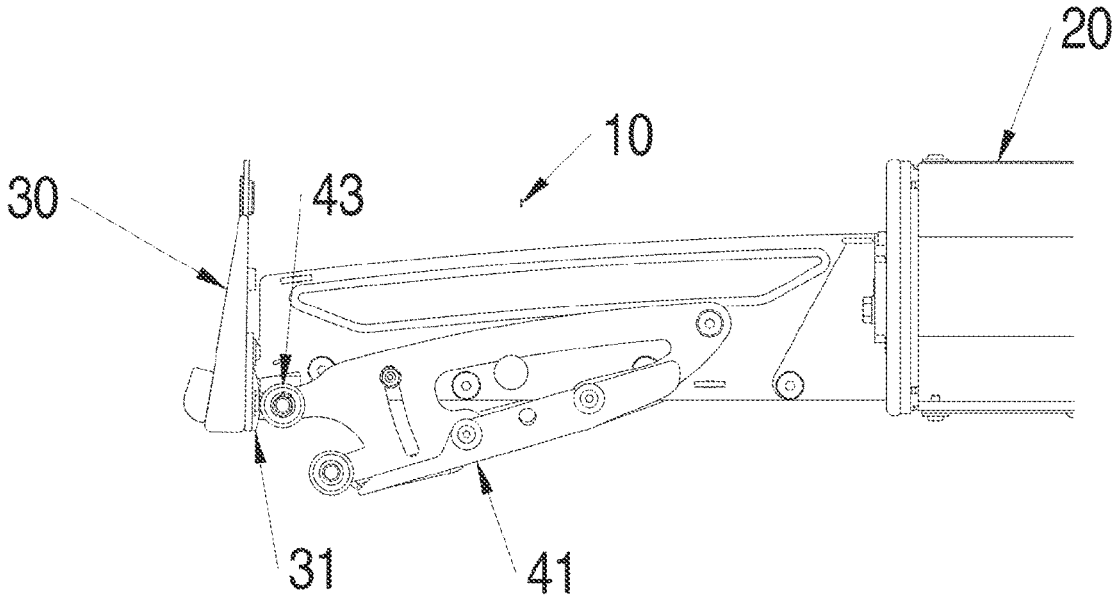
FIG. 9A illustrates a platform assembly in a horizontal position during movement into a cavity of a cassette of a wheelchair lift.
Figure 9B:
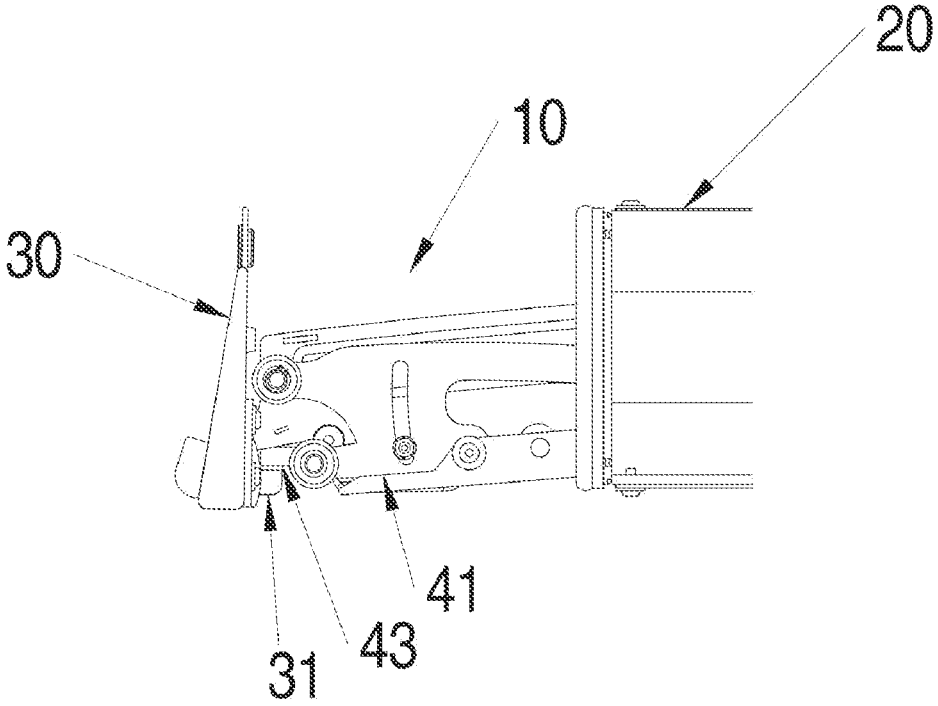
FIG. 9B illustrates a platform assembly in a horizontal position during movement into a cavity of a cassette of a wheelchair lift with a lever of a mechanical actuator mechanism bearing on a bearing surface.
Figure 9C:
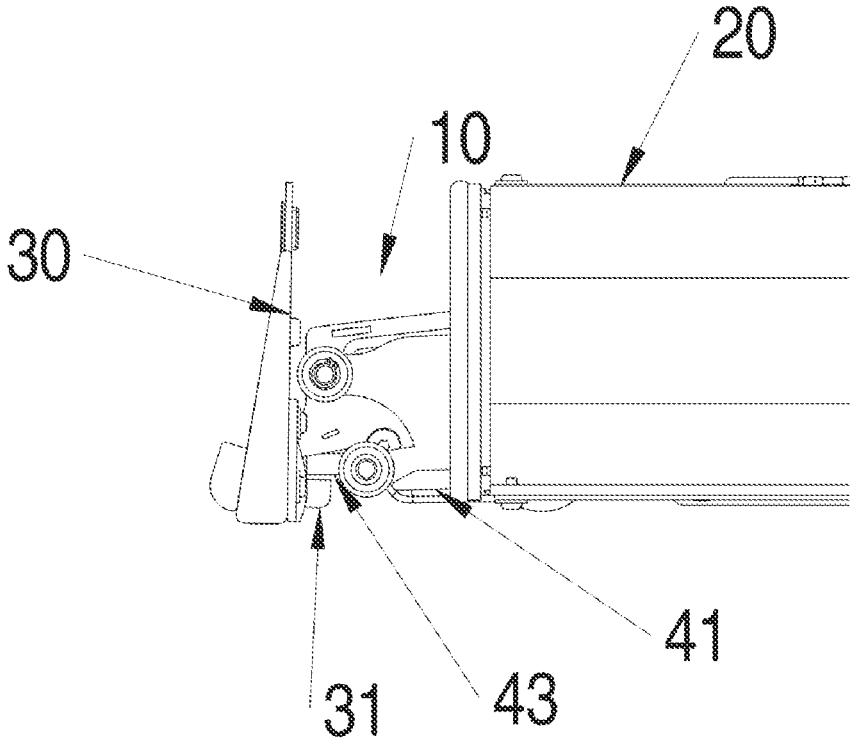
FIG. 9C illustrates a platform assembly in a horizontal position during movement into a cavity of a cassette with a roll stop means being blocked by a mechanical actuator mechanism from moving from a barrier position to an entry position.

FIGS. 9A, 9B and 9C illustrate a process of inserting the platform assembly 10 in the cavity 21 of the cassette 20. The platform assembly 10 is in the horizontal position. The mechanical actuator mechanism 40 is configured to exert a force on the roll stop means 30 to prevent moving the roll stop means by the spring mechanism 42 from the barrier position to the entry position so that the roll stop means 30 is kept in the barrier position, when the platform assembly 10 is in the horizontal position, even if the platform assembly 10 is inserted in the casing of the vehicle and the lever 41 bears on any bearing surface, for example a bottom surface of the casing of the vehicle, and is consequently lifted up.

Regarding the embodiment of the wheelchair lift comprising the cassette 20, the mechanical actuator mechanism 40 is configured to exert a force on the roll stop means 30 to prevent moving the roll stop means by the spring mechanism 42 from the barrier position to the entry position so that the roll stop means 30 is kept in the barrier position, when the platform assembly 10 is in the horizontal position, even if the platform assembly is inserted in the cavity 21 of the cassette 20 and the lever 41 bears on the bottom surface of the cassette, and is consequently lifted up.

FIG. 9A illustrates the platform assembly 10 in the horizontal position, wherein the bar 43 is extracted such that the front tip of the bar 43 is in mechanical contact with the roll stop means 30 or is at least arranged in proximity to the abutment element 31 of the roll stop means 30. It is thus ensured by the bar 43 that any movement of the roll stop means 30 from the barrier/fold-up position to the entry/fold-down position is prevented, even if the lever 41 touches any bearing surface with the bearing wheel 48 and is thus lifted up.

The lever 41 is lifted up, when the platform assembly 10 is half-inserted or completely inserted in the casing of the vehicle or in the cavity 21 of the cassette 20, as illustrated in FIGS. 9B and 9C. In this state, the lever 41 rests on the bottom surface of the inside of the casing of the vehicle or the inside of the cassette 20 and is thus lifted up. Regarding the configuration of the wheelchair lift being configured as a built-in wheelchair lift that is mounted to a vehicle, the lever 41 is also lifted up, when the platform assembly 10 is inserted in the casing of the vehicle or the cassette 20 and the bearing wheel 48 touches a step of the exit/entrance stairs of the vehicle below the platform assembly 10.

In conclusion, the construction of the mechanical actuator mechanism 40 allows that a force is exerted on the roll stop means 30 by the extracted bar 43 so that the roll stop means 30 is kept in the barrier/fold-up position when the platform assembly 10 is in the horizontal position, even if the platform assembly is moved in the casing of the vehicle or in the cavity 21 of the cassette 20, and the lever 41 bears on any bearing surface, for example a step of the exit/entrance stairs of a vehicle or is lifted up during insertion of the platform assembly 10 in the casing of the vehicle or in the cavity 21 of the cassette 20. Although the lever 41 is lifted up and thus releases the roll stop means 30 for rotation, for example urged by the spring mechanism 42, any movement of the roll stop means 30 is prevented by the extracted bar 43.

Figure 10A:
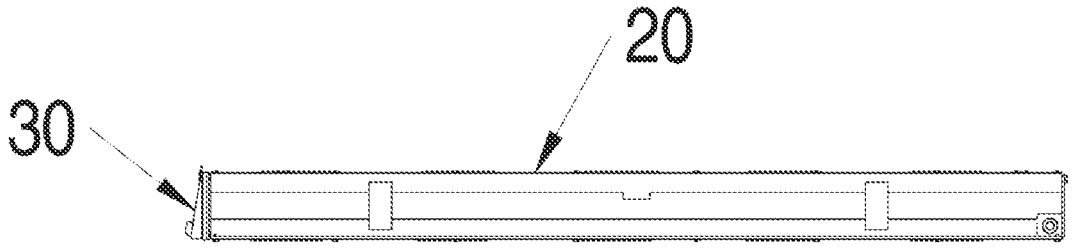
FIG. 10A illustrates a side view on a cassette of a wheelchair lift with a platform assembly housed in the cassette.
Figure 10B:
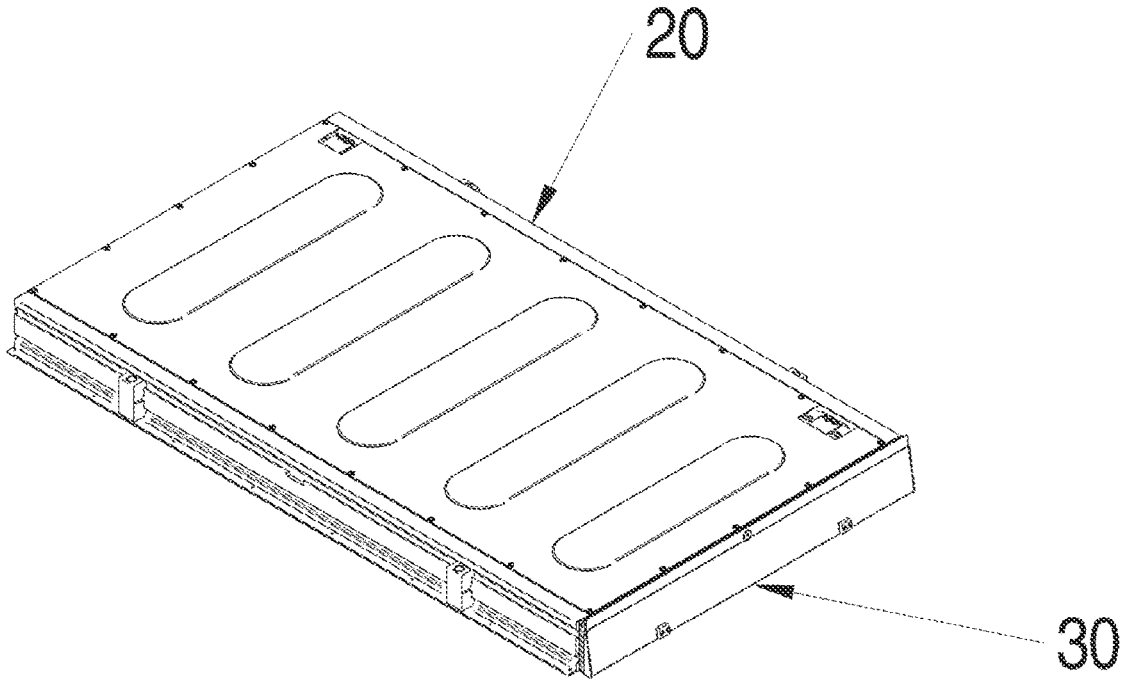
FIG. 10B illustrates a perspective view of a cassette of a wheelchair lift with a platform assembly being housed in the cassette and an opening of a cavity of the cassette being covered by a roll stop means being in a barrier position.

FIGS. 10A and 10B show the cassette 20 with the platform assembly 10 completely moved inside the cavity 21 of the cassette 20. Since the mechanical actuator mechanism 40 enables that the roll stop means 30 is kept in the barrier/fold-up position even if the lever 43 is lifted up, the roll stop means 30 may advantageously be used as a cover for covering the casing of the vehicle or the cavity 21 of the cassette 20, when the platform assembly 10 is completely inserted in the casing of the vehicle or the cassette 20.

Although only a few embodiments of the present invention have been shown and described, it is to be understood that many changes and modifications may be made thereunto without departing from the spirit and scope of the invention.

LIST OF REFERENCE SIGNS

1 wheelchair lift
10 platform assembly
11 platform
12 side panel
13 hinge
14 pin
20 cassette
21 cavity
30 roll stop means
31 abutment element
40 mechanical actuator mechanism

41 lever
42 spring mechanism
43 movable bar
44 cam
45 force transmitter
46 groove
47 abutment element
48 bearing wheel
50 lifting arm
60 bolt
70 lifting bridge
80 handrail

What is claimed is:

1. A wheelchair lift for mounting to a vehicle, comprising:

a platform assembly (10) being configured to support a wheelchair and to move between an entry level position, a horizontal position and a ground level position, wherein the entry level position is above the horizontal position and the ground level position is below the horizontal position;

a roll stop means (30) to be moved between an entry position to allow a wheelchair to be loaded to or unloaded from the platform assembly (10), and a barrier position to prevent the wheelchair from falling off the platform assembly (10); and a mechanical actuator mechanism (40) for moving the roll stop means (30) between the entry position and the barrier position; and a cassette (20) to house the platform assembly (10), the cassette (20) having a cavity (21) to insert the platform assembly (10), and the cassette being configured for mounting in a casing of the vehicle;

wherein the mechanical actuator mechanism (40) is configured to keep the roll stop means (30) in the entry position, when the platform assembly (10) is in the ground level position, and to block the roll stop means from moving from the barrier position to the entry level position, when the platform assembly (10) is in the horizontal position; and wherein the mechanical actuator mechanism (40) is configured to exert a force on the roll stop means (30) to prevent moving the roll stop means (30) from the barrier position to the entry position, when the platform assembly (10) is in the horizontal position and the roll stop means (30) is inserted in the cavity (21) of the cassette (20).

2. The wheelchair lift of claim 1, further comprising:

a lifting arm (50) to move the platform assembly (10) between the entry level position, the horizontal position and the ground level position;

wherein the mechanical actuator mechanism (40) is mechanically coupled to the movement of the lifting arm (50).

3. The wheelchair lift of claim 2, wherein the lifting arm (50) is in a horizontal position, when the platform assembly (10) is in the horizontal position;

wherein the lifting arm (50) is in a lowered position, when the platform assembly (10) is in the ground level position; and wherein the lifting arm (50) is in a raised position, when the platform assembly (10) is in the entry level position.

4. The wheelchair lift of claim 1, wherein, in the horizontal position of the platform assembly (10), the platform assembly (10) is configured to be moved in the cavity (21) of the cassette (20) by a translational movement of the platform assembly (10); and wherein the mechanical actuator mechanism (40) is configured to keep the roll stop means (30) in the barrier position, when the platform assembly (10) is inserted in the cavity (21) of the cassette (20).

5. The wheelchair lift of claim 1, wherein the mechanical actuator mechanism (40) comprises a lever (41) for moving the roll stop means (30) between the barrier position and the entry position; and wherein the lever (41) is rotatably mounted to the platform assembly (10) such that the lever (41) is moved during the movement of the platform assembly (10), when the lever (41) bears on a bearing surface.

6. The wheelchair lift of claim 5, wherein the roll stop means (30) is mechanically coupled to the lever (41) such that the roll stop means (30) is moved from the barrier position to the entry position, when the platform assembly (10) is lowered to the ground level position and the lever (41) bears on the ground, and the roll stop means (30) is moved from the entry position to the barrier position, when the platform assembly (10) is raised from the ground level position and the lever (41) is lift up from the ground.

7. The wheelchair lift of claim 5, wherein the mechanical actuator mechanism (40) comprises a spring mechanism (42) to urge moving the roll stop means (30) from the barrier position to the entry position.

8. The wheelchair lift of claim 7, wherein the lever (41) is arranged to block the roll stop means (30) from moving from the barrier position to the entry position by the spring mechanism (42), when the lever (41) is lift up from the ground; and wherein the lever (41) is arranged to release the roll stop means (30) for moving from the barrier position to the entry position urged by the spring mechanism (42), when the lever (41) bears on the ground and the platform assembly is moved in the ground level position.

9. The wheelchair lift of claim 3, wherein the mechanical actuator mechanism (40) comprises a movable bar (43) being mechanically coupled to the movement of the lifting arm (50) such that the bar (43) is moved in a first position, when the platform assembly (10) is moved in the horizontal position, and in a different second position, when the platform assembly (10) is moved in the ground level position;

wherein, in the first position of the bar (43), the bar (43) abuts on the roll stop means (30) so that the movement of the roll stop means (30) from the barrier position to the entry position is blocked; and wherein, in the second position of the bar (43), the bar (43) is retracted from the roll stop means (30) so that the roll stop means (30) is moved from the barrier position to the entry level position, when the platform assembly (10) is lowered to the ground level position and the lever (41) bears on the ground.

10. The wheelchair lift of claim 9, wherein the mechanical actuator mechanism (40) comprises a cam (44) being mechanically coupled to the lifting arm (50) such that the cam (44) is moved by the movement of the lifting arm (50); and wherein the cam (44) is mechanically coupled to the bar (43) such that the bar (43) is moved to the first position, when the lifting arm (50) is in the horizontal position, and the bar (43) is moved to the second position, when the lifting arm (50) is in the lowered position.

11. The wheelchair lift of claim 10, further comprising:

a bolt (60) having a first side and a second side;

wherein the lifting arm (50) is fixed to the first side of the bolt (60) and the cam (44) is fixed to the second side of the bolt (60) so that the cam (44) is moved by the movement of the lifting arm (50).

12. The wheelchair lift of claim 10, wherein the mechanical actuator mechanism (40) comprises a force transmitter (45) to transmit a force to the bar (43) for moving the bar (43) between the first and second position; and wherein the force transmitter (45) is mechanically coupled to the cam (44).

13. The wheelchair lift of claim 12, wherein the force transmitter (45) has a first side (45*a*) being rotatably coupled to a side panel (12) of the platform assembly (10) and a second side (45*b*) being rotatably coupled to the bar (43).

14. The wheelchair lift of claim 13, wherein a surface (S44) of the cam (44) slides along a surface (S45) of the force transmitter (45) during the movement of the lifting arm (50) between the horizontal position and the lowered position; and wherein the surface (S44) of the cam (44) and the surface (S45) of the force transmitter (45) are shaped such that the bar (43) is moved to the first position, when the lifting arm (50) is moved in the horizontal position, and the bar (43) is moved in to the second position, when the lifting arm (50) is moved to the lowered position.

* * * * *